US006158945A

United States Patent [19]

Anderson et al.

[11] Patent Number: 6,158,945

[45] Date of Patent: Dec. 12, 2000

[54] RESIDENTIAL FRONT LOADING REFUSE COLLECTION VEHICLE

[75] Inventors: James M. Anderson, Toccoa, Ga.; Robert M. Clark, Liberty, S.C.; Henry Hund, Jr., Cedar Bluff, Ala.; Diane Henry, Toccoa, Ga.

[73] Assignee: Toccoa Metal Technologies, Inc., Toccoa, Ga.

[21] Appl. No.: 08/911,663

[22] Filed: Aug. 15, 1997

(Under 37 CFR 1.47)

Related U.S. Application Data

[63] Continuation-in-part of application No. 08/400,328, Mar. 7, 1995.

[51] Int. Cl.[7] ..... B65F 3/02

[52] U.S. Cl. ..... 414/408; 414/420; 414/421; 414/699

[58] Field of Search ..... 414/406, 408, 414/699, 420, 421

[56] References Cited

U.S. PATENT DOCUMENTS

| | | | |
|---|---|---|---|
| 2,362,994 | 11/1944 | Frost | 214/78 |
| 2,581,753 | 1/1952 | Cooper | 214/78 |
| 2,624,478 | 1/1953 | Kaplan | 214/78 |
| 2,824,655 | 2/1958 | Harbers | 214/78 |
| 3,451,571 | 6/1969 | Brisson | 214/516 |
| 3,827,587 | 8/1974 | Liberman et al. | 214/302 |
| 4,085,857 | 4/1978 | Smith | 214/302 |
| 4,091,944 | 5/1978 | Gollnick | 214/302 |
| 4,349,305 | 9/1982 | Wynn et al. | 414/408 |
| 4,527,656 | 7/1985 | Walbridge | 180/321 |
| 4,538,951 | 9/1985 | Yeazel et al. | 414/407 |
| 4,673,327 | 6/1987 | Knapp | 414/408 |
| 4,687,405 | 8/1987 | Olney | 414/408 |
| 4,715,767 | 12/1987 | Edelhoff et al. | 414/408 |
| 4,866,641 | 9/1989 | Nielsen et al. | 364/559 |
| 4,921,066 | 5/1990 | Conley | 180/322 |
| 4,964,779 | 10/1990 | Sagaser | 414/708 |
| 4,986,074 | 1/1991 | Hahmann et al. | 60/468 |
| 5,033,930 | 7/1991 | Kraus | 414/408 |
| 5,188,502 | 2/1993 | Tonsor et al. | 414/700 |
| 5,333,984 | 8/1994 | Bayne et al. | 414/408 |
| 5,356,259 | 10/1994 | Hanamoto et al. | 414/694 |
| 5,446,980 | 9/1995 | Rocke | 37/348 |
| 5,458,452 | 10/1995 | Pellegrini | 414/406 |
| 5,474,413 | 12/1995 | Georg | 414/408 |
| 5,484,245 | 1/1996 | Zopf | 414/408 |
| 5,601,392 | 2/1997 | Smith et al. | 414/408 |
| 5,890,865 | 4/1999 | Smith et al. | 414/408 |

FOREIGN PATENT DOCUMENTS

| | | | |
|---|---|---|---|
| 0314238 | 5/1989 | European Pat. Off. | 414/406 |
| 496302-A1 | 7/1992 | European Pat. Off. | 414/408 |
| 3434581 C1 | 4/1986 | Germany . | |
| 3517491 A1 | 11/1986 | Germany . | |
| 3537546-A1 | 4/1987 | Germany . | |
| WO 93/15981 | 8/1993 | WIPO | 414/408 |

*Primary Examiner*—James W. Keenan
*Attorney, Agent, or Firm*—Kennedy,Davis & Hodge, LLP

[57] ABSTRACT

A refuse collection vehicle (10) has a body (14) into which refuse may be loaded having an exit passage (34) from which loaded refuse may be emptied. The vehicle also has arms (56) and a fork (58) for lifting a container into a dumping position over the body. A control circuit coordinates simultaneous operation of the arms and forks by monitoring the position of the arms and forks through rotary potentiometers (200, 201).

7 Claims, 7 Drawing Sheets

RESIDENTIAL FRONT LOADING REFUSE COLLECTION VEHICLE

REFERENCE TO RELATED APPLICATION

This is a continuation-in-part of U.S. patent application Ser. No. 08/400,328 filed Mar. 7, 1995.

BACKGROUND OF THE INVENTION

Front loading refuse collection vehicles are known. Typically, such vehicles have been used in commercial applications for lifting and dumping commercial trash containers. These vehicles include a pair of lifting arms having a corresponding pair of forks which are attached at the ends of the forks and which engage channels in the sides or bottom of the trash container to facilitate lifting thereof for dumping into the vehicle body.

The lifting arms and forks are typically operated by hydraulic cylinders which are manually controlled by the vehicle operator. A first set of hydraulic cylinders lifts the lifting arms and a second set of hydraulic cylinders rotates the forks on the lifting arms, when the lifting arms are raised, to dump refuse contained in the trash container into the vehicle body. Usually, an operator will first position the vehicle so that the forks are located within the channels, and lift the trash container above the vehicle cab in which the operator sits. Once the lifting arms are raised beyond this position, the operator selectively engages the hydraulic cylinder controls for the forks to rotate the trash container into a position for dumping. An experienced operator can work the controls for the lifting arms and rotating forks simultaneously, so that the trash container is gradually rotated into a dumping position as the lifting arms are raised.

Unlike commercial refuse collection vehicles, residential refuse collection vehicles are typically loaded from the rear. Such a rear loading vehicle is shown in U.S. Pat. No. 4,527,656 to Walbridge. A major disadvantage of rear loading refuse collection vehicles is that the driving compartment of the vehicle is fairly distant from the rear loading area. Accordingly, such vehicles require at least two-person crews, wherein one person drives the vehicle and another person loads the refuse. Alternatively, one person can perform both jobs, but such a task requires constant leaving/reentering the vehicle cab and walking to and from the cab and the rear loading area.

Mounting a refuse collection container on the front of a residential refuse collection vehicle operated by only one person, as in the typical commercial vehicle described above, would eliminate the problem of constant walking to and from the cab and the rear loading area. However, the use of a commercial-type vehicle in a residential environment presents its own problems. For example, tree limbs in residential communities provide limited clearance for the lifting arms and rotating forks on the commercial-type vehicle. In addition, because the operators of commercial-type refuse collection vehicles do not often need to leave the cab, the cabs are often sufficiently elevated to present a burden to a residential refuse collector who must constantly enter/exit the vehicle. Moreover, the commercial vehicle, provided only with forks for lifting commercial trash containers, lacks a container which resides with the vehicle and which is suitable for residential refuse collection.

Accordingly, it is an object of the present invention to provide a residential front loading refuse collection vehicle which includes a liftable container including means for minimizing the maximum height that the container will assume as it is being raised and dumped into the body of the vehicle. It is a further object of the present invention to provide such a residential front loading refuse collection vehicle having a cab which is close to ground level, to improve environmental sightlines for the operator, and to minimize the distance which the operator must cover in exiting/entering the cab each time the front container on the vehicle must be loaded. It is still a further object of the present invention to provide driving controls on each side of the vehicle cab. Yet a further object of the invention is to provide a residential front loading refuse collection vehicle having an improved container which (i) may be outfitted with a cart dumping mechanism for handling residential refuse carts, (ii) is removable for converting the vehicle into a commercial front loading refuse collection vehicle, (iii) has a low loading height to facilitate ease of loading by the operator, and (iv) may be specially compartmentalized to correspond to a compartmentalized vehicle body.

SUMMARY OF THE INVENTION

A front loading refuse collection vehicle is provided, comprising a mobile vehicle including a vehicle cab and a vehicle chassis, a body into which refuse may be loaded, and a front loader device for loading refuse into the body. The loader device comprises (i) a pair of arms which pivot about a first pivot axis located on the chassis from a loading position to an unloading position, (ii) a fork which extends from the arms and which pivots about a second pivot axis located on the arms from a loading position to an unloading position, and (iii) a container mounted upon the fork. The arms are provided with a lifting mechanism including hydraulic cylinders for lifting the arms and the fork is provided with a rotating mechanism including hydraulic cylinders for rotating the fork. A control circuit automatically coordinates simultaneous operation of the lifting mechanism and the rotating mechanism.

The control circuit includes (i) an input for receiving an actual arms position signal from the lifting mechanism indicating the position of the arms with respect to the body, (ii) a translation circuit for translating a stored arms position matching the actual arms position signal into a desired fork position corresponding to the stored arms position, and (iii) an output for outputting a fork position control signal to the rotating mechanism indicating the desired fork position, to minimize an overall maximum height that the container achieves while being lifted and rotated, while insuring that the container is sufficiently rotated to effectuate emptying of its contents into the body.

The control circuit controls the degree of rotation of the fork with respect to the arms based on the position of the arms with respect to the vehicle body. Rotary positioning sensors are utilized to report the respective positions of the fork and the arms to the control circuit. A first rotary positioning sensor is coupled to the arm. The output of first rotary positioning sensor is the actual arms position signal relative to the body. A second rotary positioning sensor is coupled to the arms and fork. The output of the second rotary positioning sensor is the actual fork position signal relative to the arms.

The outputs of the first and second rotary positioning sensor (the actual arms position signal and actual fork position signal, respectively), are used as inputs to the control circuit. The output of the control circuit is a fork position control signal which is fed into a fork hydraulic valve control. The output of the fork hydraulic valve control directs the fork hydraulic cylinder to position precisely the fork based on the detected position of the arms.

The control circuit includes a memory device for storing desired combinations of arms and corresponding fork positions. The output of the first rotary positioning sensor (the actual arms position signal) is converted into a matching stored arms position entry. The control circuit translates the stored arms position entry into a corresponding desired fork position entry. A desired fork position signal corresponding to this identified entry is used as a first input to a summing node in the control circuit. A second input to the summing node is a feedback signal which is derived from the output of the second rotary positioning sensor (actual fork position signal). The summing node sums this feedback signal with the desired fork position signal at the summing node to alter the fork position control signal output by the summing node. In this way, the combination of the controller with the two rotary positioning sensors provides real time closed loop control of the positions of the arms and the fork in the front loading vehicle.

DETAILED DESCRIPTION OF THE PREFERRED EMBODIMENT

Figure 1:
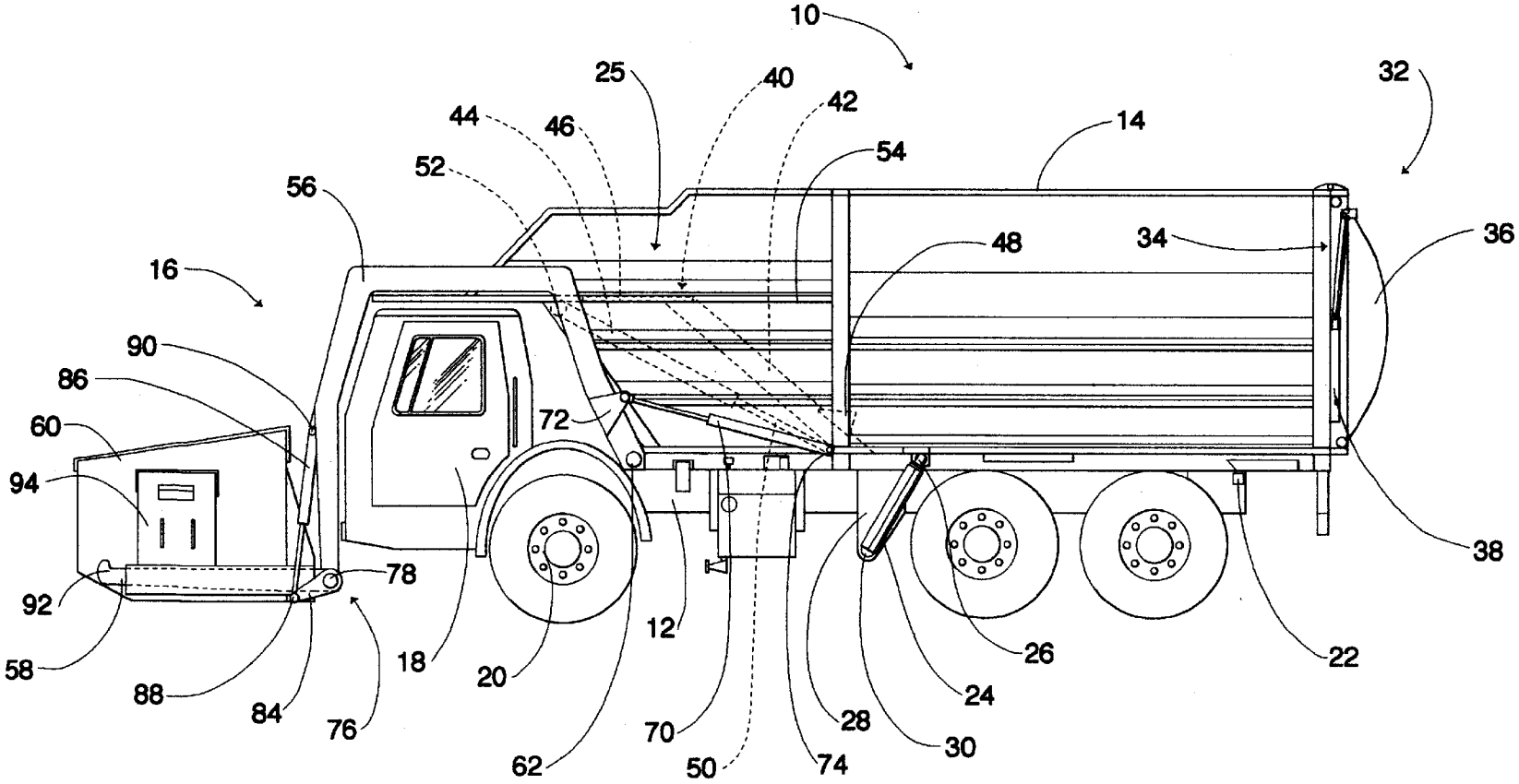
FIG. 1 is a side view of a residential front loading refuse collection vehicle constructed according to the principles of the present invention, showing the loader mechanism of the vehicle in a lowered loading position.

Referring now to the drawings, FIG. 1 shows a side view of a residential front loading refuse collection vehicle 10 constructed according to the principles of the present invention. As used herein, the term "refuse" is meant to include any type of loadable material, including but not limited to recyclable and non-recyclable materials. As shown in FIG. 1, the vehicle 10 comprises a vehicle chassis/cab 12 onto which is mounted a body 14 and a loader device 16.

The vehicle chassis/cab 12 in the preferred embodiment is a Volvo-GM truck chassis/cab model WXLL64, although it is contemplated that other chassis/cabs may be suitable for implementing the present invention. The vehicle cab includes a door 18 positioned in front of a front wheel 20 of the vehicle. The bottom of the door 18 resides below a top of the front wheel 20, so that the driver of the vehicle need not cover too great a distance when exiting and re-entering the cab to attend to the loader mechanism 16. The vehicle chassis/cab 12 is also provided with dual driving controls located on each side of the cab. Dual driving controls are available from Volvo-GM truck as an option. This option is also available from other cab/chassis manufacturers.

The body 14 is preferably welded together from steel components and is mounted to the truck chassis by a hinge 22 near the rear of the body. The front of the body 14 is connected to the chassis by a pair of cylinders 24 which are used to raise the front of the body to empty the contents of the body after it has been filled through an opening 25. The extendable (rod) ends of cylinders 24 are attached to the body 14 with bolts 26, and the inextendable ends of cylinders 24 are attached to a plate 28 on the chassis by bolts 30. The body when raised by the cylinders 24 pivots about hinge 22 to an unloading position. After being emptied, the body may be lowered back into the position shown in FIGS. 1 and 2.

The body 14 includes a tailgate assembly 32 which covers an exit passage 34 located at the rear of the body. The tailgate assembly 32 includes a tailgate 36, preferably made of steel, and a hydraulic tailgate latching mechanism 38. The hydraulic tailgate latching mechanism 38 may be either of those latching gate mechanisms disclosed in U.S. Pat. No. 4,307,541 to Farmer et al. or U. S. Pat. No. 4,665,649 to Hund, Jr., both of which are assigned to the assignee of the present invention.

Figure 3:
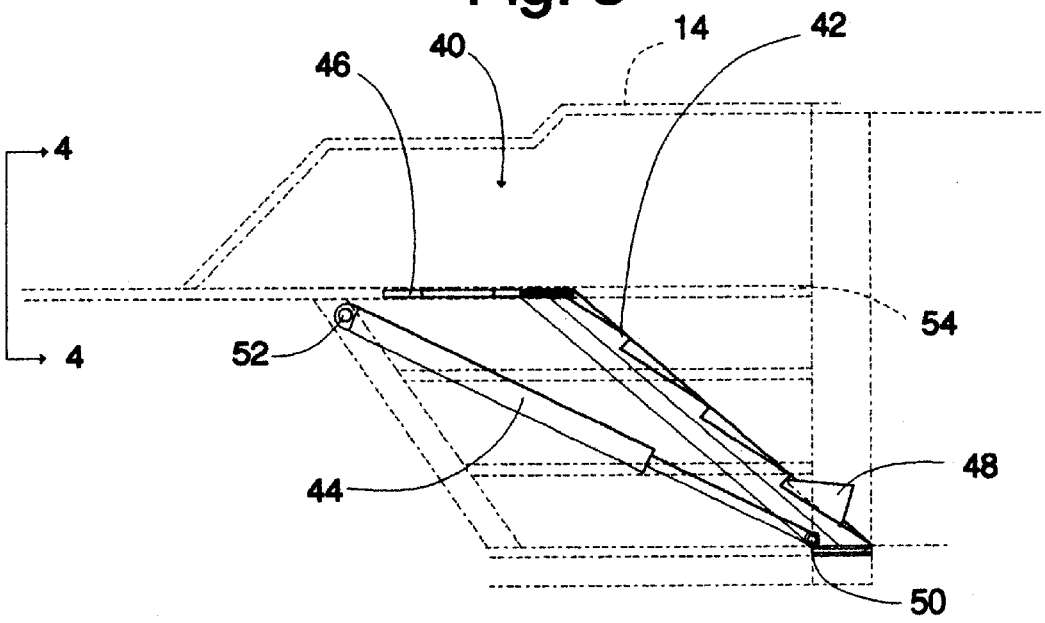
FIG. 3 is a side view of the packer mechanism of the vehicle of FIGS. 1 and 2.
Figure 4:
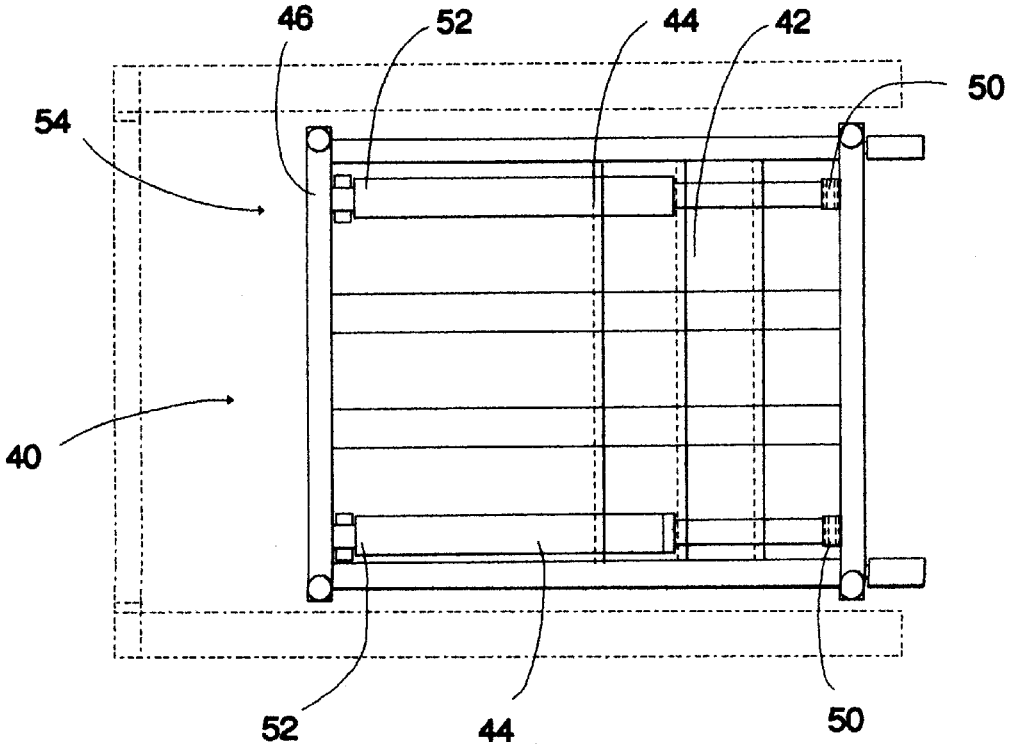
FIG. 4 is a front view of the packer mechanism of FIG. 3, taken along the lines 4—4.

The body also includes a packer mechanism 40 for packing the contents of the body 14. The packer device 40 includes a packer blade 42, a pair of packer cylinders 44, and a packer follower 46 (see also FIGS. 3 and 4). The packer blade 42 is provided with teeth 48, and accomplishes packing of the contents of the body 14 through rearward movement effectuated by the packer cylinders 44. The extendable ends of packer cylinders 44 are mounted to the packer blade 42 by bolts 50, and the inextendable ends of the packer cylinders 44 are mounted to a forward portion of the body 14 by bolts 52.

The packer follower 46 is attached to the top of the packer blade 42 and extends horizontally forward within a channel 54 in the body 14. The packer follower is slidable within the channel 54 and moves along with the packer blade 42. In addition to providing physical support for the top of the packer blade 42, the packer follower prevents material loaded through opening 25 from falling behind the packer blade 42 and interfering with the packer cylinders 44.

Figure 2:
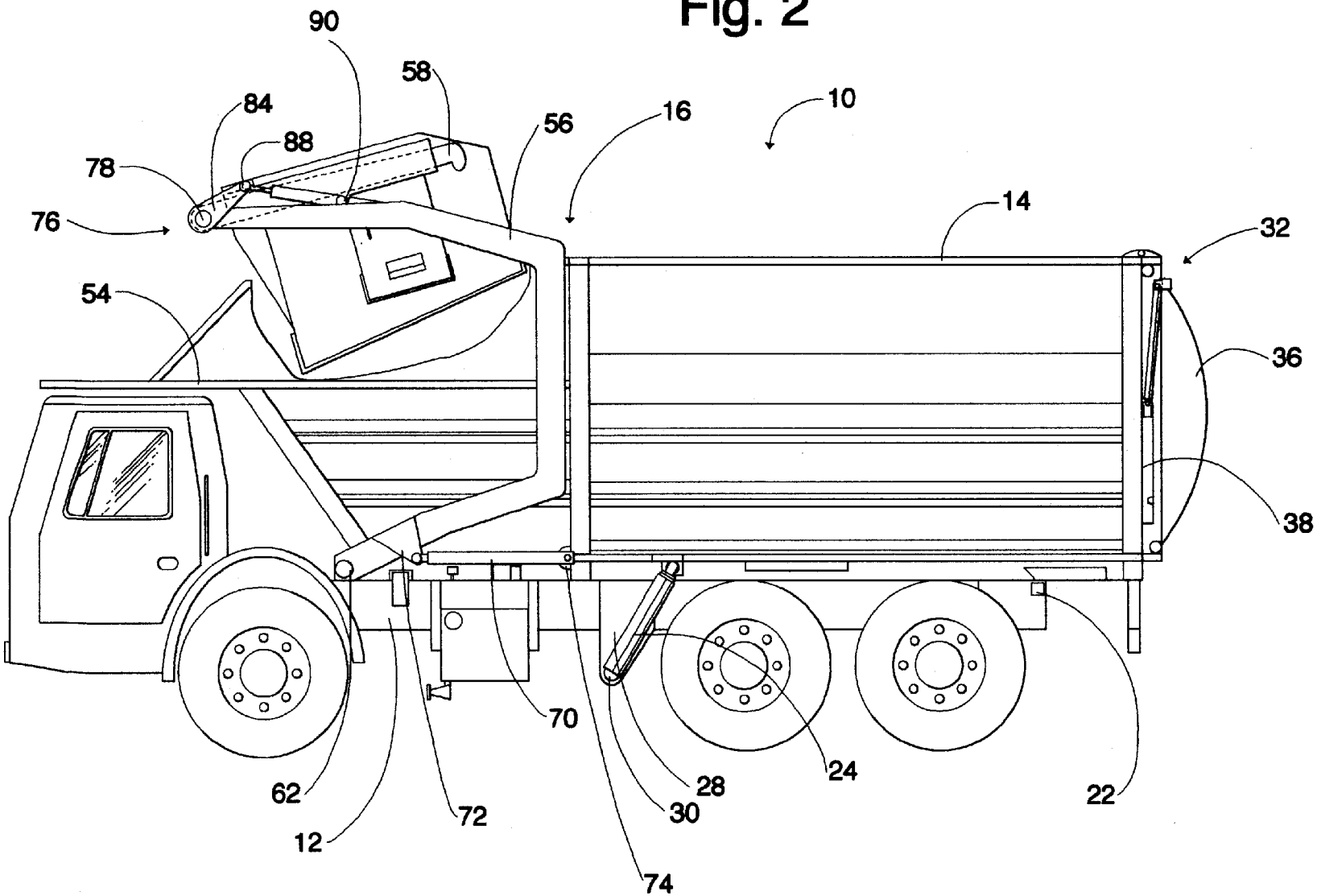
FIG. 2 is a side view of the residential front loading refuse collection vehicle of FIG. 1, showing the loader mechanism of the vehicle in a raised dumping position.
Figure 5:
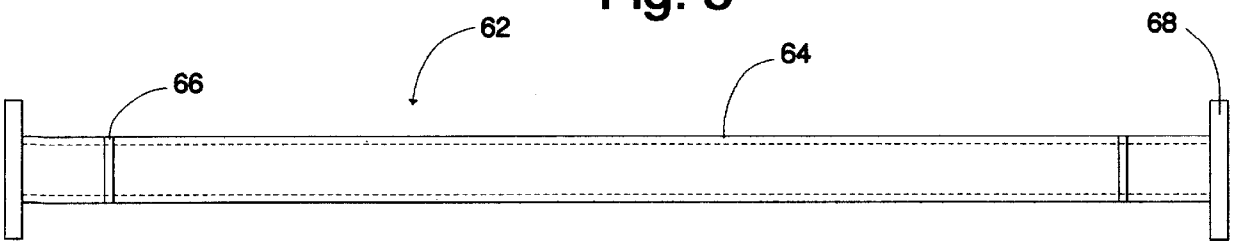
FIG. 5 is a plan view of a rear torque tube assembly for the loader mechanism of the vehicle of FIGS. 1 and 2.

The loader device 16 comprises a pair of arms 56, a rotating fork 58 having prongs 58A and 58B which extend, respectively, from the pair of arms 56, and a container 60 which rests upon the fork prongs. The arms 56 are pivotally mounted at one end to the chassis by a rear torque tube assembly 62 upon which the arms pivot between their lowered and raised positions (FIGS. 1 and 2, respectively). As shown in FIG. 5, the rear torque tube assembly 62 includes a torque tube 64 provided with a spacer 66 and a flange 68 on each end. The tube spans the arms 56 and fits through holes in the ends of the arms so that each arm is positioned between a spacer 66 and a flange 68. A ball bearing (not shown) is fitted within the holes in the ends of the arms and surrounds this portion of the tube. The rear torque tube assembly 62 having the arms installed thereon is bolted to the chassis at the locations of the flanges 68. Because the ball bearing provides a nearly frictionless interface between the arms and the rear torque tube assembly, the rear torque tube provides a fixed first pivot axis about which the loader device 16 pivots when being raised and lowered.

The arms 56 are rotated about the rear torque tube assembly 62 and a pair of cylinders 70, each one of the pair attached to a single raising arm. Each cylinder 70 is pivotally attached (i) at its extendable end to a respective arm at the location of a plate 72 secured to the arm, and (ii) at its inextendable end to the body at the location of a bracket 74 secured to the body.

As shown in their lowered position in FIG. 1, the arms 56 extend from the rear torque tube assembly 62 up the back of the cab, over the roof of the cab, and down the face of the cab. At these forward ends of the arms, opposite the rear torque tube assembly ends, is where the fork prongs 58A, 58B extend, forwardly. The fork prongs 58A, 58B are fixedly attached to the arms 56 by a front torque tube assembly 76 which extends between the forward ends of the arms.

Figure 6:
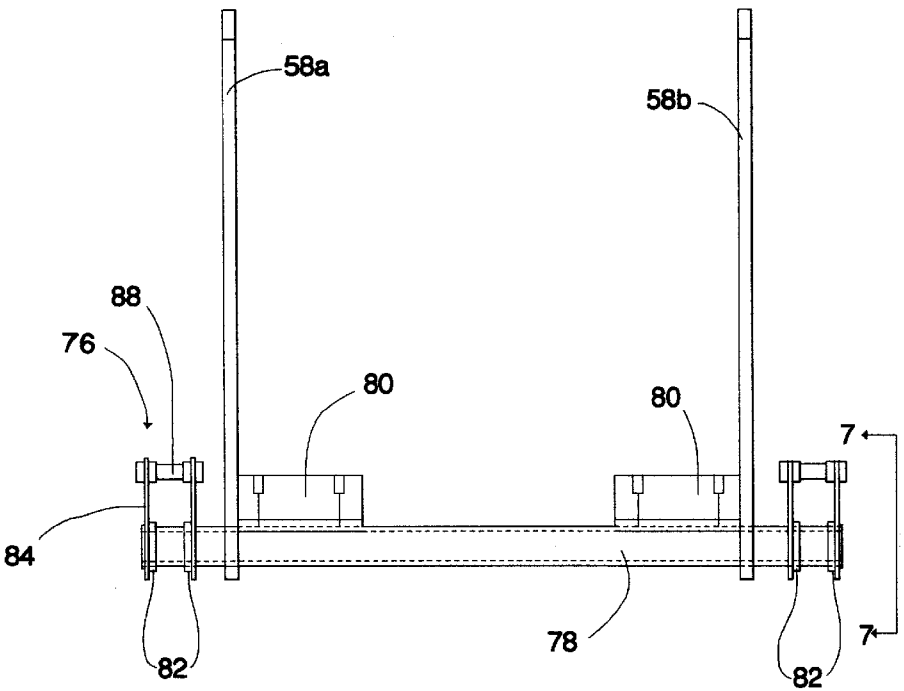
FIG. 6 is a plan view of a front torque tube assembly for the loader mechanism of the vehicle of FIGS. 1 and 2.
Figure 7:
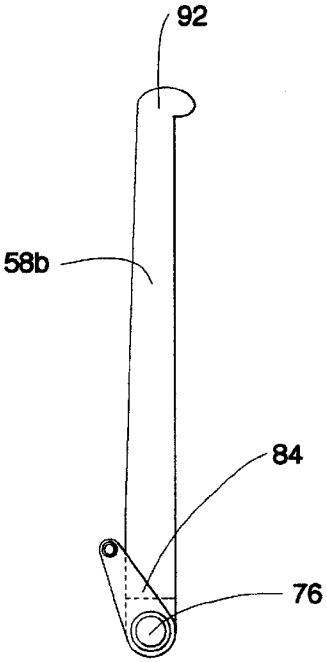
FIG. 7 is a side view of the front torque tube assembly of FIG. 6, taken along the lines 7—7.

FIGS. 6 and 7 show the front torque tube assembly in more detail, as shown assembled with the fork prongs 58A and 58B. The front torque tube assembly 76 includes a torque tube 78 which is fixedly attached to both of the fork prongs 58A and 58B by steel mounting plates 80. The tube 78 fits through holes in the forward ends of the arms so that each arm is positioned between a pair of spacers 82. A ball bearing (not shown) is fitted within the holes in the forward ends of the arms and surrounds this portion of the tube 78. Because the ball bearing provides a nearly frictionless interface between the arms and the front torque tube assembly, the torque tube provides a second pivot axis about which the fork, which is fixedly attached to the tube, rotates with respect to the arms 56.

The fork/front torque tube assembly is rotated by two pairs of levers 84, attached to the tube 78, which are moved by cylinders 86. Hydraulic fluid lines (not shown) for the cylinders 86 run along the outside of the arms 56. The levers are attached to the tube at the location of the spacers 82 (see FIG. 6). The cylinders 86 are attached at their extendable ends to the levers 86 at the location of bolts or posts 88, and at their inextendable ends to mounting brackets 90 on the arms 56. Full extension of the cylinders 86, then, maintains the fork 58 in a loading position in which the prongs extend from the arms at approximately a right angle (see FIG. 1). Full retraction of the cylinders 86 rotates the prongs about the second pivot axis defined by the front torque tube to an unloading position in which the prongs are approximately parallel with the arms (see FIG. 2).

Although in the preferred embodiment of the inventive front loading vehicle described above, cylinders 24, 44, 70, 86, and the tailgate latching mechanism 38 are all hydraulically operated, it is contemplated that other types of mechanisms for extending, lifting, pivoting and rotating may be used in practicing the invention as hereinafter claimed. Also, when hydraulic cylinders are utilized, the vehicle 10 is outfitted with a hydraulic fluid reservoir and the required control valves as is known in the art.

The container 60 in the preferred embodiment rests on the prongs of the fork 58. The position of the container is maintained on the fork by a protruding hump 92, located on the distal ends of each of the fork prongs, which prevents the container from slipping off of the fork. When used in the residential environment, the container remains on the vehicle 10 and is moved from residence to residence.

The vehicle 10, however, may also be easily converted to commercial applications by removing the container 60 from the fork 58. The fork 58, without further modification, is then ready to lift commercial-type containers by mating with fork-receiving channels therein. The arms 58 may be lowered in a manual mode of operation to a position lower than that shown in FIG. 1 so that the vehicle may back away from the commercial type container after it has been set upon the ground.

The container is also provided with an automatic cart loading device 94 attached to the container 60. The automatic cart loading device 94 may be attached to either side of the container or to the front of the container, and is used in residential areas where residents place wheeled carts curbside for pick-up. In the preferred embodiment, an automatic cart loading device such as that provided by Zarn of Reidsville, N.C. 27323 is installed on the container. Other types of automatic cart loading device units which may be installed on the container include those types shown in U.S. Pat. No. 4,673,327 to Knapp and U.S. Pat. No. 4,687,405 to Olney. The automatic cart loading device is installed as a unit and separate hydraulic lines and controls are run to the unit along the arms 56.

Figure 8:
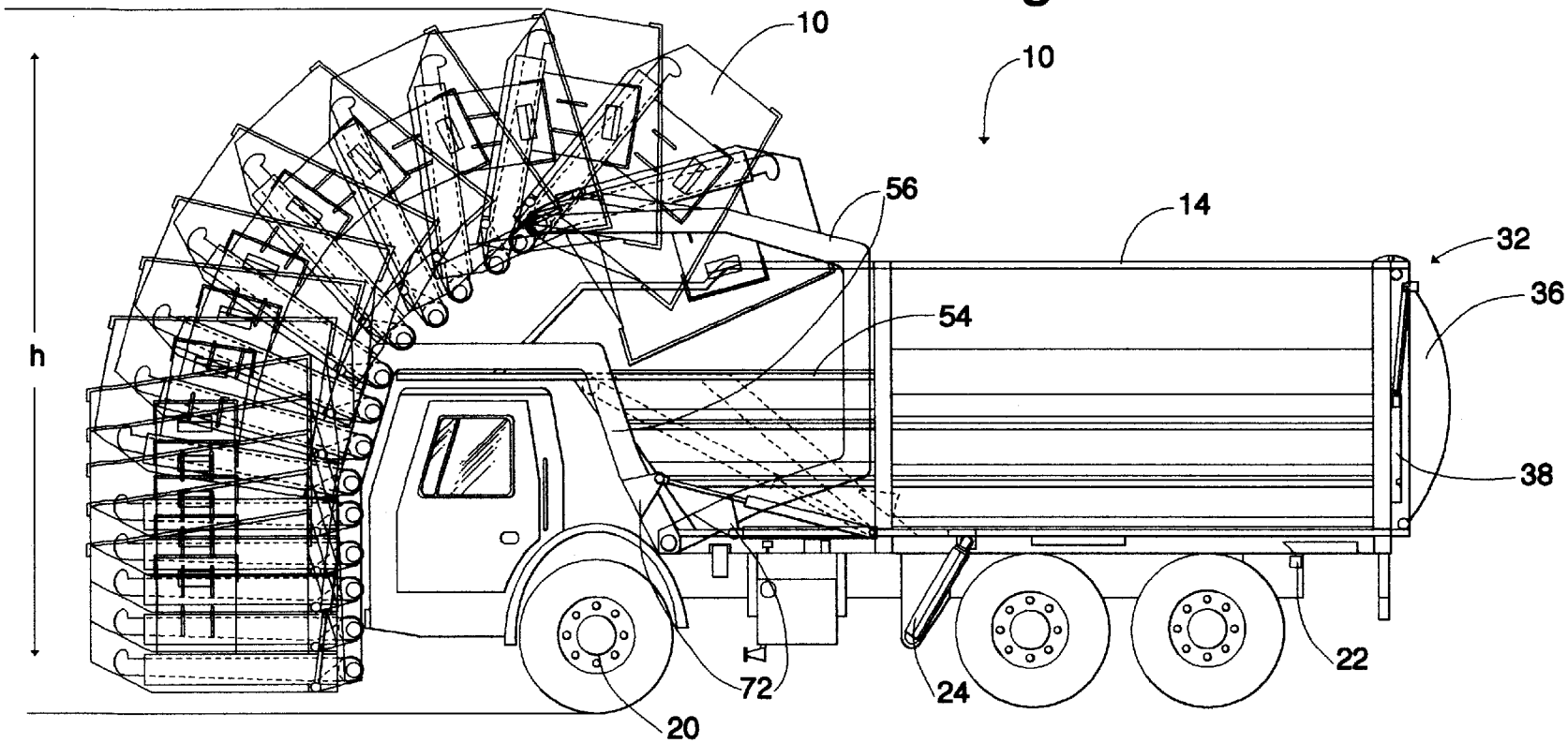
FIG. 8 is a side view of the residential front loading refuse collection vehicle of FIGS. 1 and 2, showing the various positions of the loader mechanism of the vehicle occupied between the lowered loading position of FIG. 1 and the raised dumping position of FIG. 2.

FIG. 8 is a side view of the residential front loading refuse collection vehicle of FIGS. 1 and 2, showing the various positions of the loader mechanism of the vehicle occupied between the lowered loading position of FIG. 1 and the raised dumping position of FIG. 2. As shown in FIG. 8, the container 60 reaches a maximum height h as measured from ground level during this load-unload path.

Because it is contemplated that the inventive front loading refuse collection vehicle 10 is to be used in residential environments, the vehicle loader mechanism 16 includes a control circuit (see FIG. 9) for controlling the operation of the lifting arms 56 and the fork 58 to minimize the maximum height h that the container may attain while being unloaded. The control circuit provides for operation of the loader device in an automatic mode by coordinating simultaneous operation of the arms and the fork. This automatic mode of operation permits precise articulation of the position of the fork, and thus the container positioned thereon, with respect to the arms. In this manner, it is possible to rotate the fork while the arms are being raised to articulate the container so as to minimize the overall height h that the container will achieve as it is being raised.

As further explained below, the control circuit includes (i) an input for receiving an actual arms position signal from the arms lifting mechanism indicating the position of the arms with respect to the body, (ii) a translation circuit for translating a stored arms position matching the actual arms position signal into a desired fork position corresponding to the stored arms position, and (iii) an output for outputting a fork position control signal to the rotating mechanism indicating the desired fork position, to minimize an overall maximum height that the container achieves while being lifted and rotated while insuring that the container is sufficiently rotated to effectuate emptying of its contents into the body.

Figure 9:
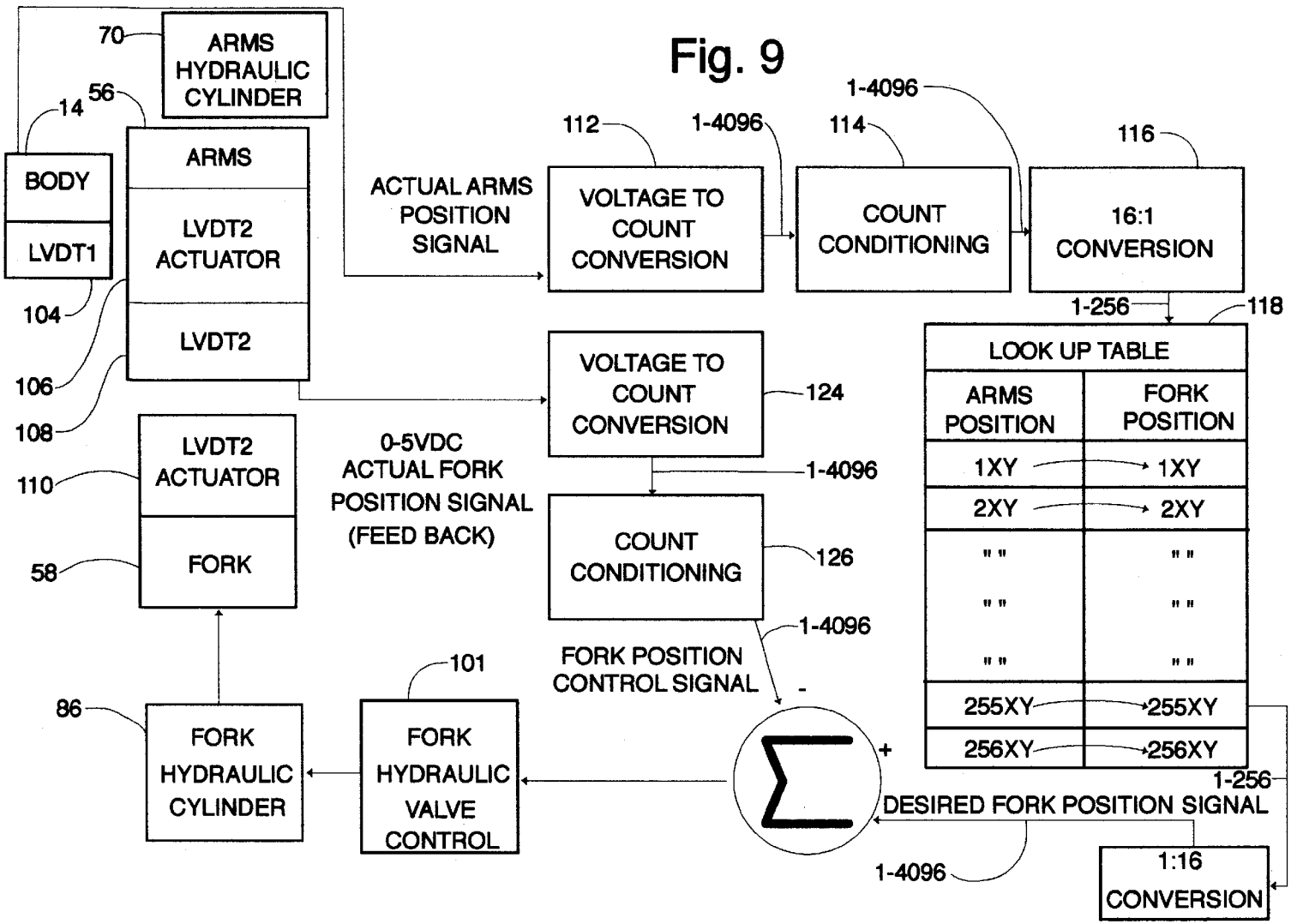
FIG. 9 is a schematic of a control circuit used to control the loader mechanism of the residential front loading refuse collection vehicle of FIGS. 1 to 3.

One embodiment of the control circuit is shown in FIG. 9 as circuit 100. The purpose of control circuit 100 is to position the fork (i.e. control the degree of rotation thereof) with respect to the arms based on the position of the arms with respect to the vehicle body. By predefining a desired position for the fork for each of a corresponding plurality of positions for the arms, and knowing the dimensions of the container positioned on the fork, the path which the container follows from the loading position to the unloading position (see FIG. 8) may be predetermined. Specifically, by predefining the corresponding arms/fork position combinations, the maximum height that the container will achieve during this path can be minimized. This manner of operation is particularly important in residential environments where vertical clearance for a front loader mechanism is limited by tree limbs, electrical wires, and other environmental obstacles. Because the control circuit 100 coordinates the position of the fork with respect to the arms, position sensors in the form of linear variable displacement transducers (LVDTS) are utilized to report the respective positions of the fork and the arms. In the preferred embodiment, LVDTs such as model F65106101, manufactured by Data Instruments of Acton, Mass., are used. A first transducer 104 (LVDT1) is mounted to the vehicle body 14 and a corresponding actuator rod 106 is mounted to the arms 56. The output of LVDT1 is the actual arms position signal relative to the body. A second transducer 108 (LVDT2) is mounted to the arms 56 with a corresponding actuator rod 110 mounted to the fork 58. The output of LVDT2 is the actual fork position signal relative to the arms.

The control circuit 100 shown in FIG. 9 is mounted in the vehicle cab and is implemented in a digital hydraulic controller such as model DMC II manufactured by Vickers of Rochester Hills, Mich. The control circuit 100 is implemented as a combination of controller hardware and programmed software which customizes the controller for the intended application. The inputs to the controller are the outputs of LVDT1 and LVDT2 (the actual arms position signal and actual fork position signal, respectively). The output of the controller is a fork position control signal which is fed into a fork hydraulic valve control 101. The output of the fork hydraulic valve control directs the fork hydraulic cylinder 86 to position the fork based on the detected position of the arms.

The actual arms position signal (output of LVDT1) is a 0–5 volts DC (VDC) signal. The controller includes a voltage-to-count converter 112 which converts the 0–5 VDC signal to a 1–4096 numerical count. This numerical count is conditioned by a count conditioner 114 to account for minor differences in LVDT outputs caused by individual LVDT operational characteristics. The conditioned 1–4096 count is then divided by 16 by divider 116 to arrive at a conditioned 1–256 count.

The conditioned 1–256 count is matched to one of a corresponding 256 arms positions which are entered and stored (i.e. programmed) into a memory device 118 such as a look-up table in the controller. In the preferred embodiment of the present invention, the memory device 118 is an electrically erasable programmable read only memory (EEPROM) device which stores 256 possible positions of the arms beginning at the loading position and ending at the unloading position. The position entries identify the position in terms of x-y (horizontal-vertical) coordinates. For example, the loading position, in which the arms cylinders are fully extended and the arms occupy their lowest vertical and most forward position, may be identified as the origin, or 0—0 position. The other 255 arms positions may be identified as measured in the x and y directions from this origin.

The HEPROM also has stored therein position entries for the fork for each of the 256 arms position entries.

Similar to the positioning scheme described above with respect to the arms, the loading position, in which the fork cylinders are fully extended and the forks extend at approximately a right angle from the arms, may be identified as the origin, or 0—0 position. The other 255 fork positions may be identified as measured in the x and y directions from this origin.

When fully programmed with all 256 arms positions and all 256 corresponding fork positions, the EEPROM 118 may be used as a look-up table to translate a stored arms position (matching the actual arms position conditioned count) into a desired fork position count corresponding thereto. The desired fork position count (1–256) is then multiplied by 16 by a multiplier 120 to arrive at a 1–4096 count which is used as a first (positive) input to a summing node 122 in the controller.

A second (negative) input to the summing node is a feedback 1–4096 count which is derived from the output of LVDT2 (actual fork position signal). This 0–5 VDC output is converted by a voltage-to-count converter 124 into the 1–4096 numerical count. This numerical count is also conditioned by a count conditioner 126 to account for minor differences in LVDT outputs. The summing node uses this conditioned count as a feedback signal which is summed with the desired fork position signal at the summing node 122 to alter the fork position control signal output by the summing node. In this way, the combination of the controller with the two LVDTs provides real time closed loop control of the positions of the arms and the fork in the front loading vehicle.

The programmability of the EEPROM permits the front loading vehicle of the present invention to be programmed for different types of operations. For example, the maximum height h that the container 60 will achieve during the load-to-unload path may be altered depending on the environment in which the vehicle is to be used. In addition, the EEPROM may be programmed with different arms/fork position combinations depending on the shape and size of the container carried by the fork.

It is contemplated that the inventive control circuit described above may be used in other types of loading vehicles other than the front loading vehicle described above. For example, the control circuit may be used for controlling the arm and fork mechanisms on a side loading or rear loading vehicle. In addition, although the above described container and vehicle body are both shown as having a single compartment, it is contemplated that the inventive control circuit may be used to control the position of a compartmentalized container which is emptied into a correspondingly compartmentalized vehicle body. For example, the container may be divided front-to-back or side-to-side by one or more internal vertical dividing walls to form two or more container compartments.

In addition, the vehicle body may be segregated into two or more vertically or horizontally oriented compartments, such as by one or more internal vertical or horizontal dividing walls in the body. In such a compartmentalized body, the exit passage 34 would be provided with a tailgate assembly 32 which includes a door for each of the body compartments. (See for example, U.S. Pat. No. 5,288,196 to Horning et al., the text of which is incorporated herein by reference as if fully set forth).

Accordingly, the preferred embodiment of a residential front loading refuse collection vehicle has been described. With the foregoing description in mind, however, it is understood that this description is made only by way of example, that the invention is not limited to the particular embodiments described herein, and that various rearrangements, modifications, and substitutions may be implemented without departing from the true spirit of the invention as hereinafter claimed.

Figure 10:
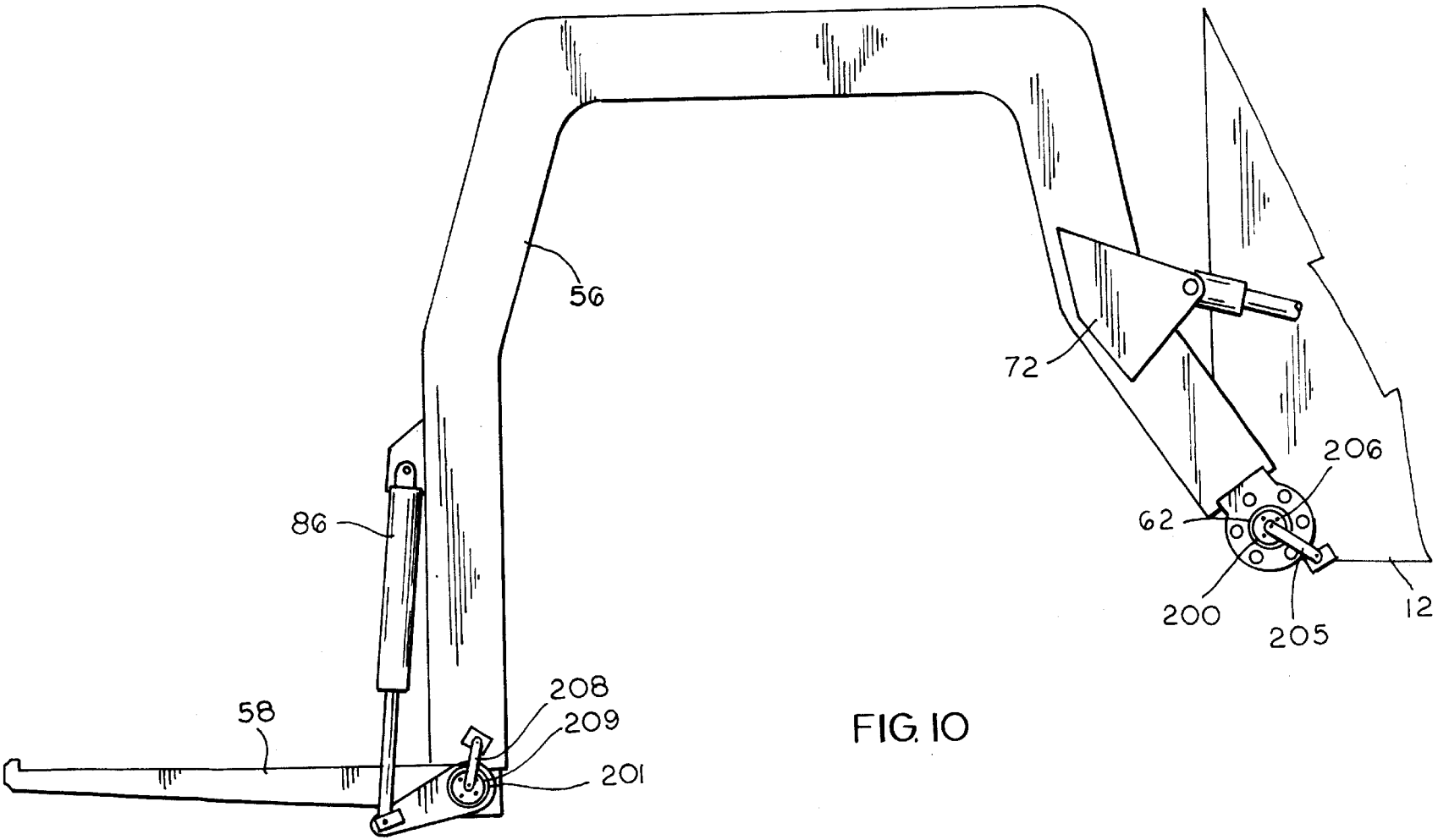
FIG. 10 is a side view of the arms and fork of a residential front loading refuse collection vehicle in another preferred form of the invention.

Referring next to FIG. 10, there is shown a collection vehicle similar to that of FIGS. 1–9 except that the linear variable displacement transducers used in connection with the fork and arms, LVDT1 and LVDT2 respectively, have been replaced with rotary positioning sensors, preferably rotary potentiometers. Here, a first rotary potentiometer 200 is coupled to the arms' rear torque tube assembly 62 along the first pivot axis to monitor the position of the arms relative to the body. A second rotary potentiometer 201 is mounted to the front torque tube assembly 76 along the second pivot axis in coupled engagement with the arms and fork 58 so as to monitor the position of the fork relative to the arms. It should be understood that the function of the rotary potentiometers 200 and 201 is the same as that previously described in reference to the LVDT1 and LVDT2.

The first rotary potentiometer 200 has a rotary arm 205 fixedly mounted to the body so that as arm 56 is pivoted its position relative to the body is detected by the positioning of the potentiometer main body 206 relative to the potentiometer arm 205. Similarly, the second rotary potentiometer 201L has a rotary arm 208 fixedly mounted to arm 56 so that as fork 58 is pivoted its position relative to arm 56 is detected and relayed by the position of the potentiometer main body 209 relative to the potentiometer arm 208.

It has been discovered that the use of rotary potentiometers provide for a smoother operation of the arms and forks as they are moved between their initial positions and their dumping positions. The reasoning for this improvement in operation is that the rate of change between any two consecutive arms and fork positions is constant or linear, i.e. the rate of change between any two positions along the arcuate path of travel is the same as any other two consecutive positions along the arcuate path of travel. This is not true with linear variable displacement transducers wherein the rate of change between consecutive positions changes along the arcuate path of travel. For instance, the rate of change between consecutive positions along the middle portion of the path of travel is faster than the rate of change between two consecutive positions along the beginning or end of the arcuate path. Hence, the rate of change with rotary potentiometers is much more predictable for use in the look-up table as compared with linear variable displacement transducers which must calculate arcuate positions using linear measurements from the LVDTs. The increased predictability greatly decreases the error range in the look-up table, consequently enabling a smoother operation of the forks for each respective arm position in a series.

Thus, an improved collection vehicle is now provided which smoothly coordinates movement of the arms and forks. While this invention has been described in detail with particular references to preferred embodiments thereof, it should be understood that many modifications, additions and deletions, in addition to those expressly recited, may be made thereto without departure from the spirit and scope of the invention as set forth in the following claims.

What is claimed is:

1. A loader device for loading a refuse collection vehicle comprising a vehicle cab, a vehicle chassis, and a body into which refuse may be loaded, the body being mounted to the vehicle chassis and having an exit passage from which loaded refuse may be emptied; said loader device comprising:

(i) an arm which pivots about a first pivot axis located on the chassis from a loading position to an unloading position, said arm including a lifting mechanism from lifting said arm;

(ii) a fork which extends from said arm and which pivots about a second pivot axis located on said arm from a loading position to an unloading position, said fork including a rotating mechanism for rotating said fork about said second pivot axis; and (iii) a control circuit for coordinating simultaneous operation of said lifting mechanism and said rotating mechanism, said control circuit including a first rotary positioning sensor mounted along said first pivot axis which senses the pivotal position of said arm and which produces an actual arm position signal indicating the position of said arm, and translation mans for receiving and translating said actual arm position signal to a corresponding desired fork position and outputting a desired fork position signal to said rotating mechanism to move a container supported upon the forks along a plurality of preselected paths of travel above the cab between a container loading position and a container dumping position.

2. The refuse collection vehicle of claim 1 wherein said first rotary positioning sensor is a rotary potentiometer.

3. The refuse collection vehicle of claim 2 wherein said control circuit further comprises a second rotary potentiometer coupled to said fork along said second pivot axis to sense the pivotal position of said fork relative to said arm and to produce an actual fork position signal imputed to said translation means to refine said desired fork position signal.

4. The refuse collection vehicle of claim 1 wherein said control circuit further comprises a second rotary positioning sensor coupled to said fork along said second pivot axis to sense the pivotal position of said fork relative to said arm and to produce an actual fork position signal imputed to said translation means to refine said desired fork position signal.

5. The refuse collection vehicle of claim 4 wherein said second rotary positioning sensor is a rotary potentiometer.

6. The refuse collection vehicle of claim 1, wherein said translation means includes a memory device for storing a look-up table which correlates a plurality of stored arm positions with a corresponding plurality of fork positions.

7. The refuse collection vehicle of claim 6, wherein said memory device is an electrically erasable programmable read only memory (EEPROM) device.

* * * * *